United States Patent [19]

Prouty

[11] Patent Number: 4,587,675

[45] Date of Patent: May 13, 1986

[54] TROUSERS WITH BUILT IN SHAPING STRAPS

[76] Inventor: Dwight Prouty, 1623 Third Ave., New York, N.Y. 10028

[21] Appl. No.: 546,873

[22] Filed: Oct. 31, 1983

[51] Int. Cl.[4] ..... A41D 1/06

[52] U.S. Cl. ..... 2/227; 2/234

[58] Field of Search ..... 2/227, 79, 403–404, 2/238, 234, 228, 229, 78 R, 78 C, 406, 407; 128/158, 159, 524, 531, 528, 519; D2/32–34, 28–31

[56] References Cited

U.S. PATENT DOCUMENTS

| | | | |
|---|---|---|---|
| 1,832,687 | 11/1931 | Boshnack | 2/234 |
| 2,027,622 | 1/1936 | Stam | 128/159 |
| 2,232,950 | 2/1941 | Kneibler | 2/234 |
| 3,797,501 | 3/1974 | DiTullio | 2/407 |
| 4,091,466 | 5/1978 | Kearn | 2/227 |
| 4,475,552 | 10/1984 | Yoshihara | 128/531 |

FOREIGN PATENT DOCUMENTS

| | | | |
|---|---|---|---|
| 792426 | 12/1935 | France | 2/403 |
| 2146678 | 2/1973 | France . | |
| 976890 | 12/1964 | United Kingdom | 2/227 |

*Primary Examiner*—Peter Nerbun
*Assistant Examiner*—Joseph S. Machuga
*Attorney, Agent, or Firm*—Alfred Musumeci

[57] ABSTRACT

A pair of trousers including two tubular leg portions having an upper extremity sloping upwardly away from the crotch to a point below the waist, a pair of straps or welts extending down and inwardly from the waist and crossing in the crotch, thereafter extending across the lower portion of the buttocks and attached below the waist to the opposing strap, said straps defining and being attached to the upper extremities of said leg portions, a triangular front piece between said straps and including closure means along one side, and a five-sided, downwardly-pointed back section sewn along its lower edges to the rear portions of said straps and along its upper edges to the topmost front portions of said straps, the top edges of said front and back sections defining the waist, and a waist band including a fastener at the top of the closure means. The trousers feature comfortably shaped legs, a back section shaped for comfort while still being snug, and a front section that is eased for comfort both in standing and sitting positions. The crossed straps can be either external or internal, depending on design/construction considerations.

6 Claims, 6 Drawing Figures principle and scope of the invention as defined in the appended claims.

For example, the straps 16 and 18 may be in the form of welts sewn into the inside of the trousers. Of course, it will be appreciated from the foregoing description that the trousers of the present invention essentially constitute diagonally-closing trousers, wherein the conventional fly-front is located at 26 so as to open diagonally on the side, with the straps or welts 16, 18 constituting means for providing greater comfort and fit.

I claim:

1. A pair of trousers comprising:

two tubular leg portions having upper edges extending upwardly and away from a crotch to a point below the waist;

a pair of straps secured to said upper edges, each said strap extending down and inwardly from the waist and crossing and being attached to each other in the crotch, thereafter extending around the buttocks along said upper edges and being attached to the other said strap at said point below the waist;

first closure means along the upper, frontal portion of one said strap;

a triangular front panel, a top edge of said front panel defining a front portion of said waist, said front panel being secured to the frontal portion of said straps down to said crossing point; and a five-sided rear panel, a top edge of said rear panel defining a rear portion of said waist, said rear panel being secured to the rear portions of said straps, said rear panel extending outwardly to said point below the waist and downwardly to said crossing point.

2. The pair of trousers as claimed in claim 1, and additionally comprising a waistband secured to the top edges of said front and rear panels and including second closure means adjacent said first closures means.

3. The pair of trousers as claimed in claim 1, herein said front panel is bias cut to have more give, thereby increasing wearer comfort.

4. The pair of trousers as claimed in claim 1, wherein said front panel is dimensioned to be slightly cupped, thereby increasing wearer comfort.

5. The pair of trousers as claimed in claim 1, wherein said first closure means is a zipper.

6. The pair of trousers as claimed in claim 1, wherein said front and rear panels are one, intergral piece.

* * * * *

TROUSERS WITH BUILT IN SHAPING STRAPS

BACKGROUND OF THE INVENTION

The present invention relates in general to trousers, and more particularly, it relates to close-fitting jeans or slacks that are more comfortable than such garments as are readily available.

Typically, a good-fitting pair of mens jeans or slacks fits snugly across the buttocks and through the crotch, is flat across the front, and will include etiher straight or tapered legs. Unfortunately, the "better" such a garment fits while the wearer is standing, the more likely it is to bind through the crotch and become uncomfortable when he sits. The present invention overcomes this problem in a unique fashion, while still providing an attractive garment, by providing a pair of straps or welts that cross in the crotch and form (when viewed from above) a general FIG-8 pattern that connect separate front, rear and leg portions, with a diagonal front closure, generally a zipper.

Diagonally-closing trousers have been known in the past, U.S. Pat. No. 1,832,687 of Boshnack an U.S. Pat.No. 2,506,411 of Brohard being typical. More novel designs include Ficcio, U.S. Pat. No. 1,861,383, including a removable triangular gusset as a front portion, and Cooper, U.S. Pat. No. 226,643, featuring a triangular fly with the flat portion at the bottom. Kalil, U.S. Pat. No. 3,806,953, features overlapping triangular front panels with an integral, wrap-around belt and buckle. French Pat. No. 2,146,678 is similar to Boshnack.

OBJECTS OF THE INVENTION

It is a general object of the present invention to provide more comfortable and more attractive trousers than those currently available.

A further object of the present invention is to provide comfortable and attractive trousers that can be readily adapted to a variety of body types.

Yet another object of the invention is to provide trousers that are snug-fitting but do not bind through the crotch in the sitting position.

Various other objects and advantages of the invention will become clear from the following description of an embodiment of same, and the novel features will be particularly pointed out in connection with the appended claims.

THE DRAWINGS

Reference will hereinafter be made to the accompanying drawings, wherein.

DESCRIPTION OF EMBODIMENTS

The present invention is based, at least in part, upon the observation that an ordinary men's athletic supporter is comfortable when the wearer is standing, sitting, running or whatever, and the invention incorporates some of the principles of construction of such a garment into similarly comfortable trousers.

Figure 1:
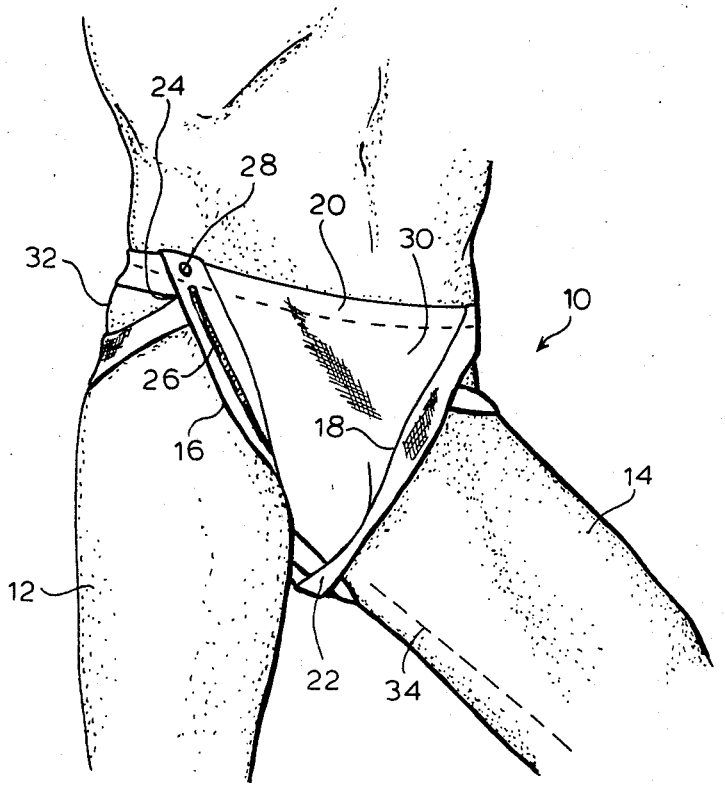
FIG. 1 is a perspective view showing the invention on a wearer, with the novel straps exposed.

The invention will be more readily appreciated by referring to the drawings, and attention is directed thereto. In FIG. 1, the trousers of the invention 10 are seen to comprise a pair of tubular leg sections 12, 14 sewn at their upper ends to a pair of straps 16, 18 that extend from a waistband 20, which cross and are sewn together in the crotch at 22, encircle the buttocks, and are sewn to the opposite strap at a point 24 below the waist. One strap (16) is provided with a zipper 26 or other closure means, and waistband 20 includes a snap-fastener 28, button or the like. A triangular front panel 30 is sewn between straps 16 and 18 and extends down to point 22. A five-sided rear panel 32 is sewn to the rear portions of straps 16, 18 and also extends downwardly to crotch 22.

An important feature of the invention is that front panel 30 be dimensioned so as to be eased or cupped in the lower portions thereof, providing comfort for the wearer in any position.

A further feature of the invention is that rear panel 32 be dimensioned to snugly fit the buttocks, be they large or small. In other words, a person with a 24 inch inseam and a 34 inch waist may have relatively large or small buttocks; in accordance with the invention, this may be accomodated by changing the dimensions of rear panel 32.

It is to be noted waistband 20 may be a separate element secured to the top edges of the front and rear panels of the trousers or may merely be a folded-over portion of front panel 30 and rear panel 32.

As shown in FIG. 1, leg portion 14 is formed with an inside seam 34, but it will be appreciated that placement of seam 34 is at the option of the designer. Further, FIG 1 shows straps 16, 18 as being external of the garment but in most instances they will be internal; in either event an optional flap (not shown) may be provided to cover zipper 26.

Figure 2:
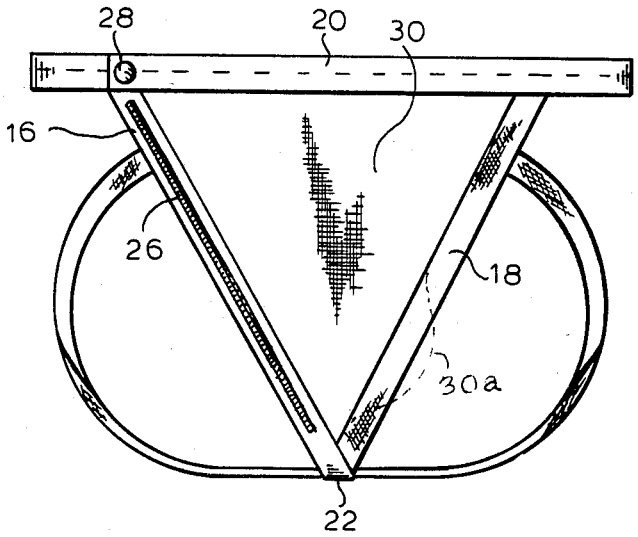
FIG. 2 is an elevation view of the waistband, strap and front portions of the invention.
Figure 3:
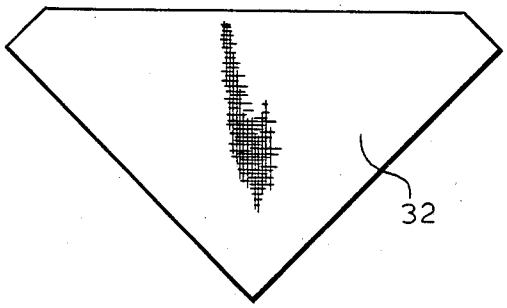
FIG. 3 is an elevation view of the back section of the invention.
Figure 4:
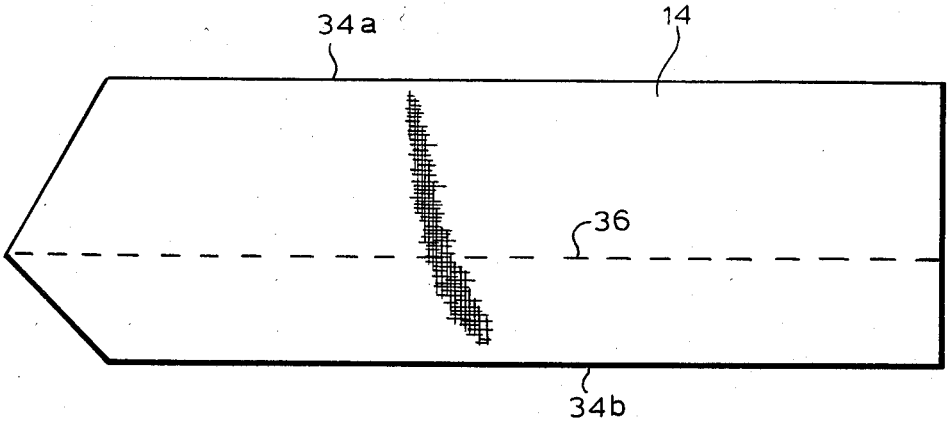
FIG. 4 is a pattern for a leg portion of the invention.
Figure 5:
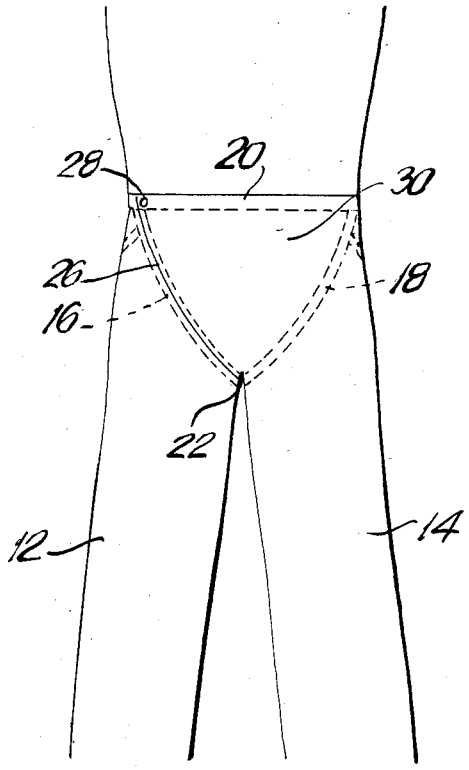
FIG. 5 shows a front view of the trousers.
Figure 6:
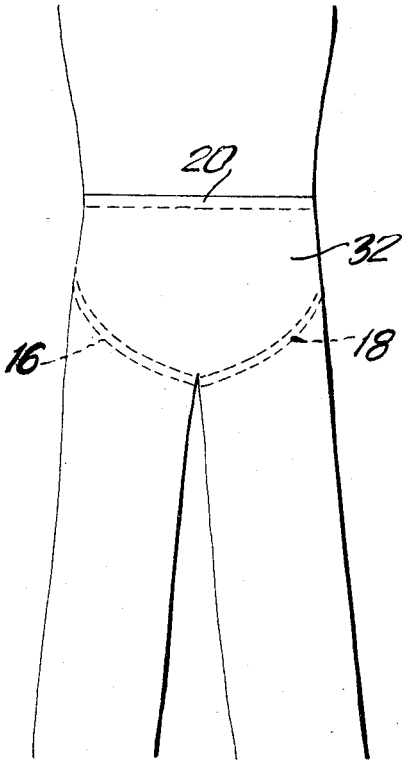
FIG. 6 shows a rear view of the trousers.

FIG. 2 shows the construction of straps 16, 18, waistband 20 and front panel 30 in frontal elevation view. FIG. 3 shows the pattern of back panel 32 as five-sided, which might be described as a trapezoid on top of a downwardly-pointing triangle. FIG. 4 shows the pattern for a leg portion 14 with an inside seam. If, for instance, an outside seam were desired, edges 34(*a*) and 34(*b*) would be joined and the seam would be along (dotted) line 36. For purely design purposes, it is also possible to cover seams, wherever located, with straps similar to straps 16, 18.

To achieve the cupping or easing of front panel 30 noted hereinabove, it is preferred that panel 30 be bias cut, thereby providing more "give" in the finished garment. However, for a more pronounced cupping effect, front panel 30 may be cut as shown on phantom at 30(*a*) FIG. 2 on both the descending sides thereof. When such and edge is sewn straight, into stap 18 and 16, a more pronounced effect will be obtained.

It is possible of course, to form the front and rear panels (30,32) from a single piece of material, though in general this expedient would not be favored insofar as its irregular shape would make pattern cutting without significant wastage difficult.

Various changes in the details, steps, materials, and arrangements of parts, which been herein described and illustrated in order to explain the nature of the invention, may be made by those skilled in the art within the